US009821544B2

(12) United States Patent
Xue et al.

(10) Patent No.: US 9,821,544 B2
(45) Date of Patent: Nov. 21, 2017

(54) VEHICLE WHEEL ROLLING CARVING DEVICE

(71) Applicant: CITIC Dicastal CO., LTD, Qinhuangdao (CN)

(72) Inventors: Bowen Xue, Qinhuangdao (CN); Jiandong Guo, Qinhuangdao (CN)

(73) Assignee: Citic Dicastal Co., Ltd., Qinhuangdao (CN)

( * ) Notice: Subject to any disclaimer, the term of this patent is extended or adjusted under 35 U.S.C. 154(b) by 0 days.

(21) Appl. No.: 15/383,479

(22) Filed: Dec. 19, 2016

(65) Prior Publication Data

US 2017/0182761 A1 Jun. 29, 2017

(30) Foreign Application Priority Data

Dec. 29, 2015 (CN) ..... 2015 1 1006532

(51) Int. Cl.
*B41F 17/00* (2006.01)
*B41F 3/54* (2006.01)

(52) U.S. Cl.
CPC ..... *B41F 3/54* (2013.01)

(58) Field of Classification Search
CPC ..... B41F 3/54; B41F 17/26; B41F 17/006; B60B 30/06; B60B 30/08; B60B 2310/213; B60B 2310/226; B60B 2310/646; B60B 2310/658; B60B 2900/572; B60B 2310/206
See application file for complete search history.

(56) References Cited

U.S. PATENT DOCUMENTS

| | | | | |
|---|---|---|---|---|
| 9,492,865 | B2 * | 11/2016 | Xue | B22D 17/2236 |
| 9,586,394 | B2 * | 3/2017 | Xue | B41F 17/006 |
| 9,597,865 | B2 * | 3/2017 | Xue | B41F 17/28 |
| 2014/0064903 | A1 * | 3/2014 | Starz | B65G 47/52 414/751.1 |
| 2016/0311215 | A1 * | 10/2016 | Xue | B41F 17/006 |
| 2016/0311216 | A1 * | 10/2016 | Xue | B41F 17/28 |
| 2016/0346887 | A1 * | 12/2016 | Xue | B23Q 7/043 |
| 2017/0144480 | A1 * | 5/2017 | Kerwin | B60B 30/06 |

* cited by examiner

*Primary Examiner* — David Banh
(74) *Attorney, Agent, or Firm* — Calfee, Halter & Griswold LLP

(57) ABSTRACT

The present invention discloses an improved vehicle wheel rolling carving device, consisting of a left impressing system, a right impressing system, a lower synchronous clamping driving system, a left support system, a right support system, an upper synchronous clamping driving system and the like. The lower synchronous clamping driving system enables a vehicle wheel to rotate under the clamped state, the left support system moves towards the right, the right support system moves towards the left and thus left and right support rolls contact the rotating vehicle wheel; meanwhile, the upper synchronous clamping driving system enables two shafts II and two shafts III to clamp the wheel and apply auxiliary clamping forces to drive the vehicle wheel to rotate; and after the left and the right impressing system rise to different heights, impression carving can be performed on different positions of a back cavity of the vehicle wheel.

1 Claim, 4 Drawing Sheets

VEHICLE WHEEL ROLLING CARVING DEVICE

CROSS-REFERENCE TO RELATED APPLICATIONS

This application claims priority to Chinese Patent Application No. 201511006532.7, filed on Dec. 29, 2015, which is hereby incorporated by reference in its entirety.

TECHNICAL FIELD

The present invention relates to a vehicle wheel carving device, in particular to an improved vehicle wheel rolling carving device.

BACKGROUND ART

During a production process of forging an aluminum alloy wheel, after machining, corresponding text information needs to be carved at different positions of a rim of a back cavity of the vehicle wheel for increasing retroactivity. At present, carving is performed in two ways including pneumatic carving and laser carving, and both the two ways need to be operated manually, thus the efficiency is low, the amount of labor is large, and the phenomena that carved characters are unclear and inaccurate in position may occur when operation staffs clamp the vehicle wheel inappropriately; and in order to enhance productivity and improve clarity and position accuracy of the carved characters, the present invention provides a full-automatic online vehicle wheel rolling carving device.

SUMMARY OF THE INVENTION

An object of the present invention is to provide an improved vehicle wheel rolling carving device, which can perform rolling carving on different positions of a back cavity of a vehicle wheel.

An improved vehicle wheel rolling carving device comprises a left impressing system, a right impressing system, a lower synchronous clamping driving system, a left support system, a right support system, an upper synchronous clamping driving system, a rack and a clamping cylinder II.

The left impressing system comprises a left jacking hydraulic cylinder, left guide pillars I, a bottom plate, a guide rail I, left guide sleeves I, a left sliding plate I, a left tensioning hydraulic cylinder, a left lifting frame, a left servo motor I, a left press roll, a left belt wheel I, a left synchronous belt I and a left belt wheel II.

The left sliding plate I on which the four left guide sleeves I are fixed is installed above the bottom plate via the guide rail I. The four left guide pillars I matched with the left guide sleeves I are fixed under the left lifting frame; the left jacking hydraulic cylinder is fixed under the left sliding plate I, and an output end of the left jacking hydraulic cylinder is connected with the lower side of the left lifting frame. The left tensioning hydraulic cylinder is fixed on the left side of the rack, and an output end of the left tensioning hydraulic cylinder is connected with the left sliding plate I. The left press roll of which an upper end is provided with the left belt wheel II is installed on the left side of the left lifting frame. The left servo motor I is fixed on the right side of the left lifting frame, the left belt wheel I is fixed at an output end of the left servo motor I, and the left belt wheel I and the left belt wheel II are connected by the left synchronous belt I.

The right impressing system comprises a right belt wheel II, a right synchronous belt I, a right belt wheel I, a right press roll, a right servo motor I, a right lifting frame, a right tensioning hydraulic cylinder, a right sliding plate I, right guide sleeves I, right guide pillars I and a right jacking hydraulic cylinder. The right sliding plate I on which the four right guide sleeves I are fixed is installed above the bottom plate via the guide rail I. The four right guide pillars I matched with the right guide sleeves I are fixed under the right lifting frame; the right jacking hydraulic cylinder is fixed under the right sliding plate I, and an output end of the right jacking hydraulic cylinder is connected with the lower side of the right lifting frame. The right tensioning hydraulic cylinder is fixed on the right side of the rack, and an output end of the right tensioning hydraulic cylinder is connected with the right sliding plate I. The right press roll of which an upper end is provided with the right belt wheel II is installed on the right side of the right lifting frame via a bearing. The right servo motor I is fixed on the left side of the right lifting frame, the right belt wheel I is fixed at an output end of the right servo motor I, and the right belt wheel I and the right belt wheel II are connected by the right synchronous belt I.

The lower synchronous clamping driving system comprises a middle plate, guide rails II, gear racks I, a left sliding plate II, shafts I, bearing blocks I, an rolling wheel, a right sliding plate II, a clamping cylinder I, a drive motor and gears I. The left sliding plate II and the right sliding plate II are installed above the middle plate via the guide rails II. Two bearing blocks I are fixed on each of the left sliding plate II and the right sliding plate II, and the two gear racks I are fixed under each of the left sliding plate II and the right sliding plate II. The two gears I engaged with the gear racks I are also fixed above the middle plate. The four shafts I on which the rolling wheels are fixed respectively are installed in the four bearing blocks I via bearings. The drive motor is fixed under the right sliding plate II, and an output end of the drive motor is connected with one of the right shafts I. The clamping air cylinder I is fixed on the right side of the rack, and an output end of the clamping air cylinder I is connected with the right sliding plate II.

The left support system comprises left guide pillars II, left guide sleeves II, a left support hydraulic cylinder, a left support frame, left support rolls, a left servo motor II, a left belt wheel III, a left synchronous belt II, a left tensioning wheel and left belt wheels IV. The four left guide sleeves II are fixed on the left side of the rack, and the four left guide pillars II matched with the four left guide sleeves II are fixed on the left side of the left support frame. The left support hydraulic cylinder is fixed on the left side of the rack, and an output end of the left support hydraulic cylinder is connected with the left support frame. The two left support rolls of which upper ends are provided with the left belt wheels IV respectively are installed on the left support frame via bearings. The left servo motor II is fixed under a top plate of the left support frame, the left belt wheel III is fixed at an output end of the left servo motor II. The left tensioning wheel is installed on the top plate of the left support frame. The left belt wheel III, the two left belt wheels IV and the left tensioning wheel are connected by the left synchronous belt II.

The right support system comprises right belt wheels IV, a right tensioning wheel, a right synchronous belt II, a right belt wheel III, a right servo motor II, right support rolls, a right support frame, a right support hydraulic cylinder, right guide sleeves II and right guide pillars II. The four right guide sleeves II are fixed on the right side of the rack, and the four right guide pillars II matched with the four right guide sleeves II are fixed on the right side of the right support frame. The right support hydraulic cylinder is fixed on the right side of the rack, and an output end of the right support hydraulic cylinder is connected with the right support frame. The two right support rolls of which upper ends are provided with the right belt wheels IV respectively are installed on the right support frame via bearings. The right servo motor II is fixed under a top plate of the right support frame, and the right belt wheel III is fixed at an output end of the right servo motor II. The right tensioning wheel is installed on the top plate of the right support frame. The right belt wheel III, the two right belt wheels IV and the right tensioning wheel are connected by the right synchronous belt II.

The upper synchronous clamping driving system comprises shafts II, a left servo motor III, bearing blocks II, a left belt wheel V, a left sliding table, a left synchronous belt III, left belt wheels VI, guide rails III, a lifting plate, gear racks II, a gear II, upper guide pillars, upper guide sleeves, lifting hydraulic cylinders, right belt wheels VI, a right synchronous belt a III, a right sliding table, a right belt wheel V, bearing blocks III, a right servo motor III and shafts III. The upper sides of the left sliding table and the right sliding table are installed under the lifting plate via the guide rails III. One gear rack II is fixed on each of the left sliding table and the right sliding table, and the gear II engaged with the gear racks II is installed below the lifting plate. The two bearing blocks II are fixed under the left sliding table, and the two shafts II of which top ends are provided with the left belt wheels VI respectively are installed in the bearing blocks II via bearings. The left servo motor III is fixed under the left sliding table, the left belt wheel V is installed at an output end of the left servo motor III, and the left belt wheel V and the left belt wheels VI are connected by the left synchronous belt III. The two bearing blocks III are fixed under the right sliding table, and the two shafts III of which top ends are provided with the right belt wheels VI respectively are installed in the bearing blocks III via bearings. The right servo motor III is fixed under the right sliding table, and the right belt wheel V is installed at an output end of the right servo motor III. The right belt wheel V and the right belt wheels VI are connected by the right synchronous belt III. The two lifting hydraulic cylinders and the four upper guide sleeves are fixed on a top end of the rack. The four upper guide pillars matched with the four upper guide sleeves are fixed on the lifting plate, and output ends of the lifting hydraulic cylinders are hinged to the upper side of the lifting plate.

When in actual use, the lower synchronous clamping driving system drives a vehicle wheel to rotate under the clamped state, after a proper position is found, the left support system moves towards the right, the right support system moves towards the left and thus the left support rolls and the right support rolls contact the rotating vehicle wheel; meanwhile, the upper synchronous clamping driving system also enables the two shafts II and the two shafts III to clamp the vehicle wheel and apply auxiliary clamping forces to drive the vehicle wheel to rotate; after the left impressing system and the right impressing system rise to different heights respectively, impression carving can be performed on different positions of a back cavity of the vehicle wheel.

When in use, the improved vehicle wheel rolling carving device can perform rolling carving on different positions of the back cavity of the vehicle wheel, with very clear carving effect, and meanwhile has the advantages of high degree of automation, advanced technology, simple structure and safe and stable performance.

Figure 1:
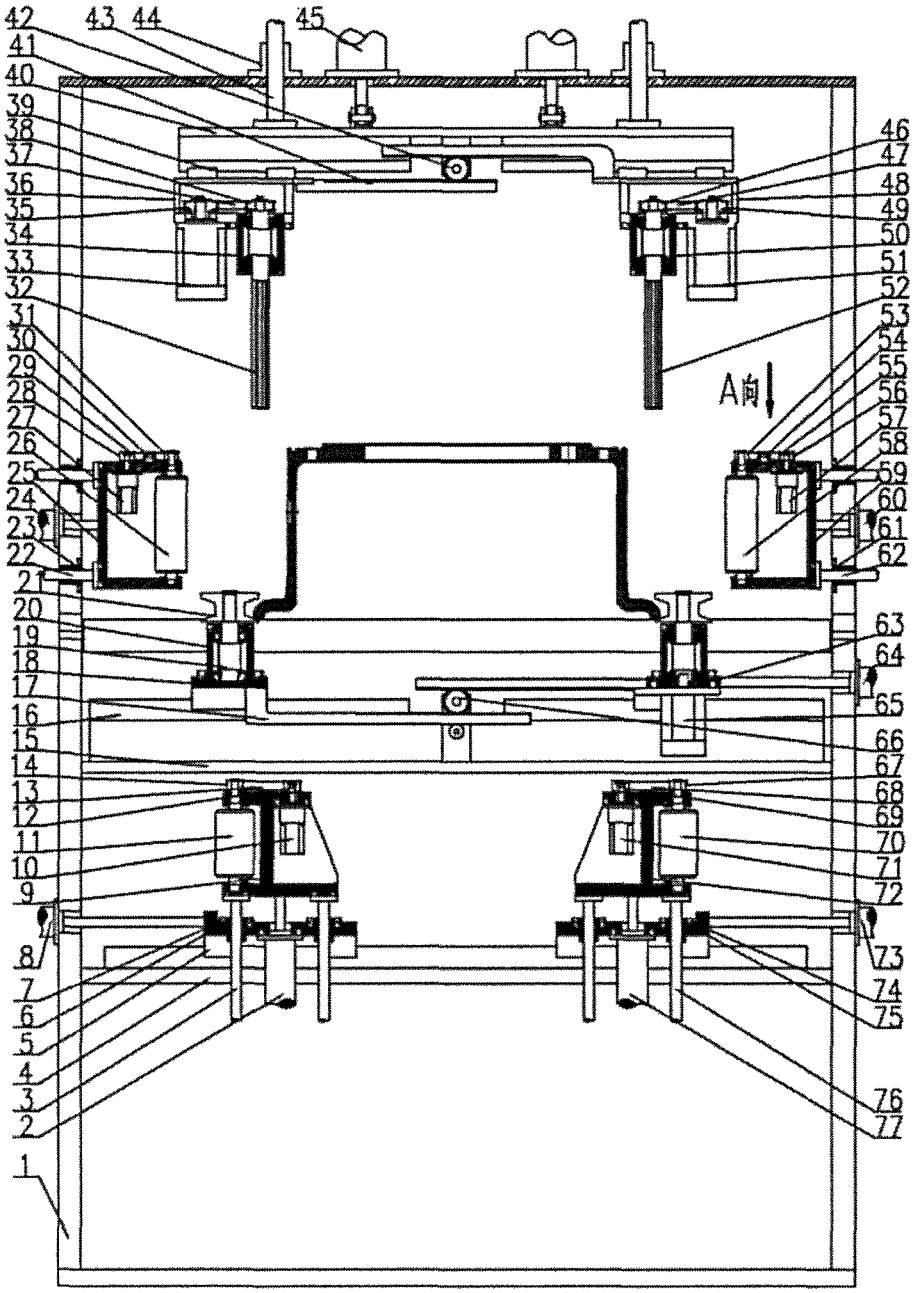
FIG. 1 is a front view of an improved vehicle wheel rolling carving device provided by the present invention.
Figure 2:
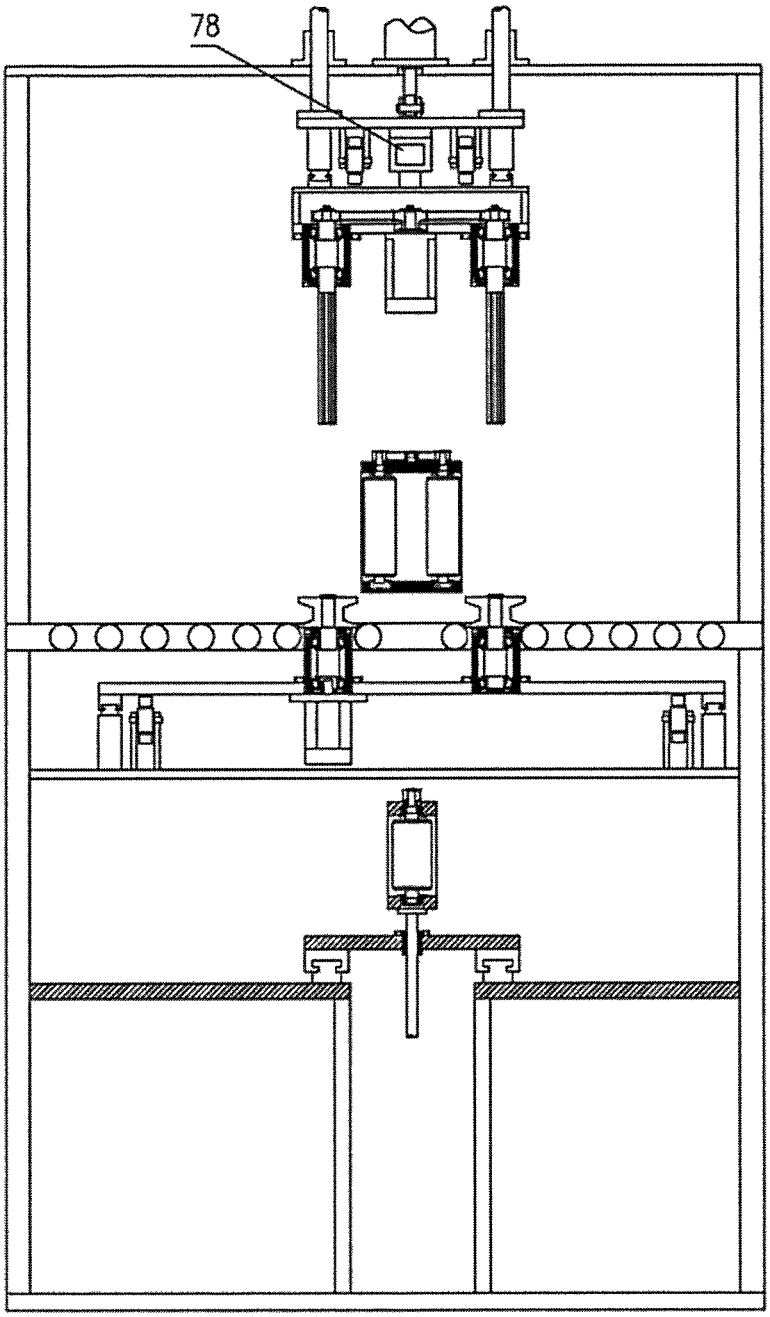
FIG. 2 is a left view of an improved vehicle wheel rolling carving device provided by the present invention.
Figure 3:
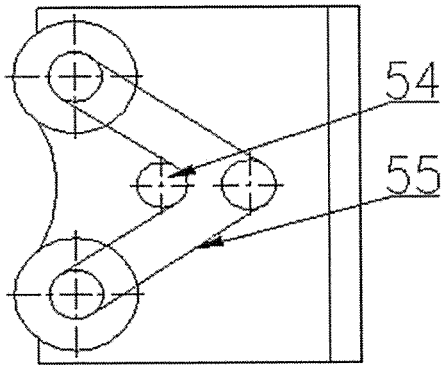
FIG. 3 is an A reference arrow view of an improved vehicle wheel rolling carving device provided by the present invention.
Figure 4:
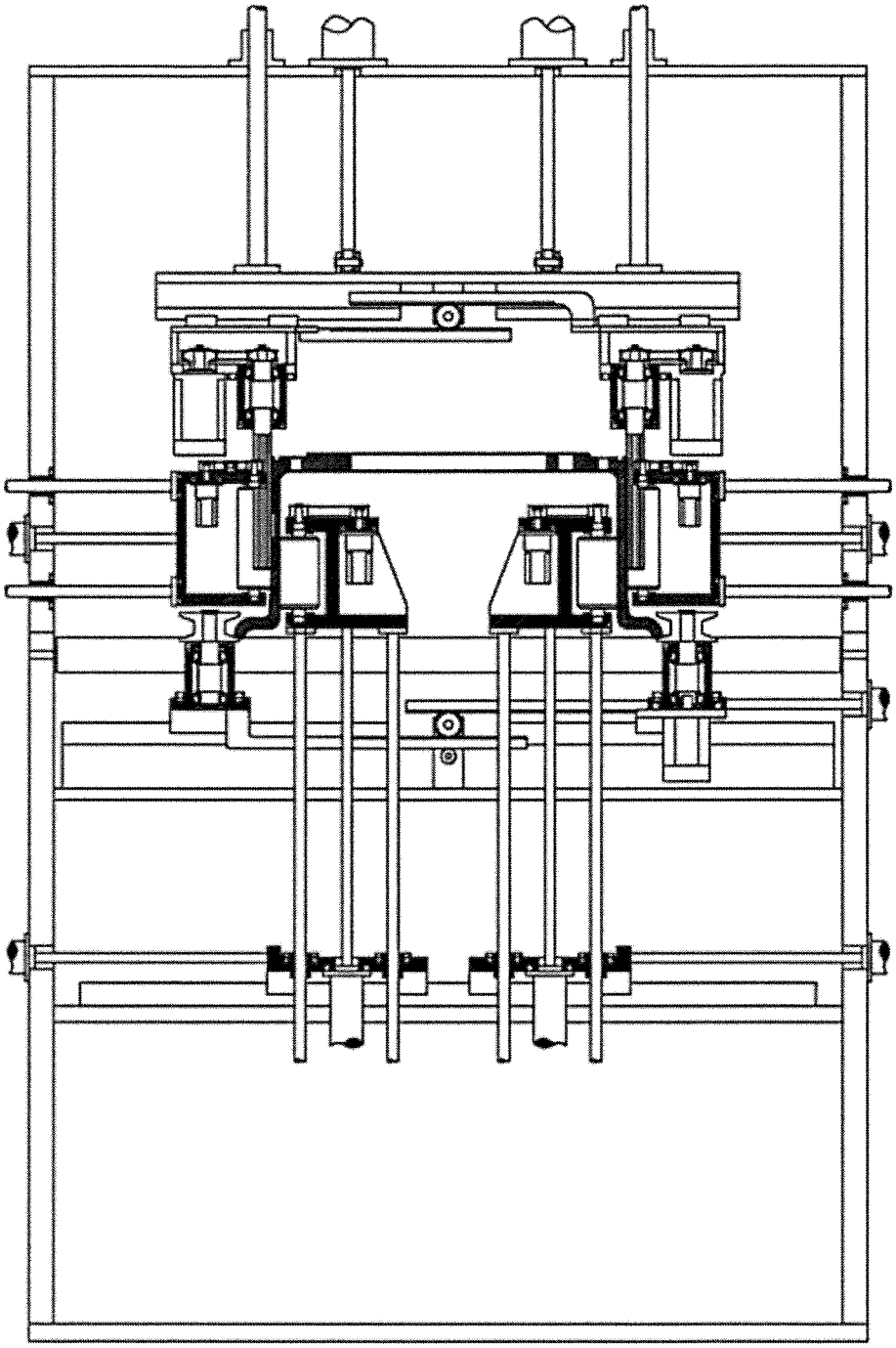
FIG. 4 is a front view of an improved vehicle wheel rolling carving device provided by the present invention during working.

In the figures, 1—rack, 2—left jacking hydraulic cylinder, 3—left guide pillar I, 4—bottom plate, 5—guide rail I, 6—left guide sleeve I, 7—left sliding plate I, 8—left tensioning hydraulic cylinder, 9—left lifting frame, 10—left servo motor I, 11—left press roll, 12—left belt wheel I, 13—left synchronous belt I, 14—left belt wheel II, 15—middle plate, 16—guide rail II, 17—gear rack I, 18—left sliding plate II, 19—shaft I, 20—bearing block I, 21—rolling wheel, 22—left guide pillar II, 23—left guide sleeve II, 24—left support hydraulic cylinder, 25—left support frame, 26—left support roll, 27—left servo motor II, 28—left belt wheel III, 29—left synchronous belt II, 30—left tensioning wheel, 31—left belt wheel IV, 32—shaft II, 33—left servo motor III, 34—bearing block II, 35—left belt wheel V, 36—left sliding table, 37—left synchronous belt III, 38—left belt wheel VI, 39—guide rail III, 40—lifting plate, 41—gear rack II, 42—gear II, 43—upper guide pillar, 44—upper guide sleeve, 45—lifting hydraulic cylinder, 46—right belt wheel VI, 47—right synchronous belt III, 48—right sliding table, 49—right belt wheel V, 50—bearing block III, 51—right servo motor III, 52—shaft III, 53—right belt wheel IV, 54—right tensioning wheel, 55—right synchronous belt II, 56—right belt wheel III, 57—right servo motor II, 58—right support roll, 59—right support frame, 60—right support hydraulic cylinder, 61—right guide sleeve II, 62—right guide pillar II, 63—right sliding plate II, 64—clamping cylinder I, 65—drive motor, 66—gear I, 67—right belt wheel II, 68—right synchronous belt I, 69—right belt wheel I, 70—right press roll, 71—right servo motor I, 72—right lifting frame, 73—right tensioning hydraulic cylinder, 74—right sliding plate I, 75—right guide sleeve I, 76—right guide pillar I, 77—right jacking hydraulic cylinder, and 78—clamping cylinder II.

DETAILED DESCRIPTION OF THE INVENTION

In the following, the details and working conditions of a specific device provided by the present invention are described in combination with figures.

An improved vehicle wheel rolling carving device comprises a left impressing system, a right impressing system, a lower synchronous clamping driving system, a left support system, a right support system, an upper synchronous clamping driving system, a rack and a clamping cylinder II.

The left impressing system comprises a left jacking hydraulic cylinder 2, left guide pillars I 3, a bottom plate 4, a guide rail I 5, left guide sleeves I 6, a left sliding plate I 7, a left tensioning hydraulic cylinder 8, a left lifting frame 9, a left servo motor I 10, a left press roll 11, a left belt wheel I 12, a left synchronous belt I 13 and a left belt wheel II 14.

The left sliding plate I 7 on which the four left guide sleeves I 6 are fixed is installed above the bottom plate 4 via the guide rail I 5; the four left guide pillars I 3 matched with the left guide sleeves I 6 are fixed under the left lifting frame 9, the left jacking hydraulic cylinder 2 is fixed under the left sliding plate I 7, and an output end of the left jacking hydraulic cylinder 2 is connected with the lower side of the left lifting frame 9; the left tensioning hydraulic cylinder 8 is fixed on the left side of the rack 1, and an output end of the left tensioning hydraulic cylinder 8 is connected with the left sliding plate I 7; the left press roll 11 of which an upper end is provided with the left belt wheel II 14 is installed on the left side of the left lifting frame 9 via a bearing; and the left servo motor I 10 is fixed on the right side of the left lifting frame 9, the left belt wheel I 12 is fixed at an output end of the left servo motor I 10, and the left belt wheel I 12 and the left belt wheel II 14 are connected by the left synchronous belt I 13.

The right impressing system comprises a right belt wheel II 67, a right synchronous belt I 68, a right belt wheel I 69, a right press roll 70, a right servo motor I 71, a right lifting frame 72, a right tensioning hydraulic cylinder 73, a right sliding plate I 74, right guide sleeves I 75, right guide pillars I 76 and a right jacking hydraulic cylinder 77. The right sliding plate I 74 on which the four right guide sleeves I 75 are fixed is installed above the bottom plate 4 via the guide rail I 5; the four right guide pillars I 76 matched with the right guide sleeves I 75 are fixed under the right lifting frame 72, the right jacking hydraulic cylinder 77 is fixed under the right sliding plate I 74, and an output end of the right jacking hydraulic cylinder 77 is connected with the lower side of the right lifting frame 72; the right tensioning hydraulic cylinder 73 is fixed on the right side of the rack 1, and an output end of the right tensioning hydraulic cylinder 73 is connected with the right sliding plate I 74; the right press roll 70 of which an upper end is provided with the right belt wheel II 67 is installed on the right side of the right lifting frame 72 via a bearing; and the right servo motor I 71 is fixed on the left side of the right lifting frame 72, the right belt wheel I 69 is fixed at an output end of the right servo motor I 71, and the right belt wheel I 69 and the right belt wheel II 67 are connected by the right synchronous belt I 68.

The lower synchronous clamping driving system comprises a middle plate 15, guide rails II 16, gear racks I 17, a left sliding plate II 18, shafts I 19, bearing blocks I 20, rolling wheels 21, a right sliding plate II 63, a clamping cylinder I 64, a drive motor 65 and gears I 66. The left sliding plate II 18 and the right sliding plate II 63 are installed above the middle plate 15 via the guide rails II 16; two bearing blocks I 20 are fixed on each of the left sliding plate II 18 and the right sliding plate II 63, and the two gear racks I 17 are fixed under each of the left sliding plate II 18 and the right sliding plate II 63; the two gears I 66 engaged with the gear racks I 17 are also fixed above the middle plate 15; the four shafts I 19 on which the rolling wheels 21 are fixed respectively are installed in the four bearing blocks I 20 via bearings; the drive motor 65 is fixed under the right sliding plate II 63, and an output end of the drive motor 65 is connected with one of the shafts I 19; and the clamping cylinder I 64 is fixed on the right side of the rack 1, and an output end of the clamping cylinder I 64 is connected with the right sliding plate II 63.

The left support system comprises left guide pillars II 22, left guide sleeves II 23, a left support hydraulic cylinder 24, a left support frame 25, left support rolls 26, a left servo motor II 27, a left belt wheel III 28, a left synchronous belt II 29, a left tensioning wheel 30 and left belt wheels IV 31. The four left guide sleeves II 23 are fixed on the left side of the rack 1, the four left guide pillars II 22 matched with the four left guide sleeves II 23 are fixed on the left side of the left support frame 25; the left support hydraulic cylinder 24 is fixed on the left side of the rack 1, and an output end of the left support hydraulic cylinder 24 is connected with the left support frame 25; the two left support rolls 26 of which upper ends are provided with the left belt wheels IV 31 respectively are installed on the left support frame 25 via bearings; the left servo motor II 27 is fixed under a top plate of the left support frame 25, and the left belt wheel III 28 is fixed at an output end of the left servo motor II 27; the left tensioning wheel 30 is installed on the top plate of the left support frame 25; and the left belt wheel III 28, the two left belt wheels IV 31 and the left tensioning wheel 30 are connected by the left synchronous belt II 29.

The right support system comprises right belt wheels IV 53, a right tensioning wheel 54, a right synchronous belt II 55, a right belt wheel III 56, a right servo motor II 57, right support rolls 58, a right support frame 59, a right support hydraulic cylinder 60, right guide sleeves II 61 and right guide pillars II 62. The four right guide sleeves II 61 are fixed on the right side of the rack 1, the four right guide pillars II 62 matched with the four right guide sleeves II 61 are fixed on the right side of the right support frame 59; the right support hydraulic cylinder 60 is fixed on the right side of the rack 1, and an output end of the right support hydraulic cylinder 60 is connected with the right support frame 59; the two right support rolls 58 of which upper ends are provided with the right belt wheels IV 53 respectively are installed on the right support frame 59 via bearings; the right servo motor II 57 is fixed under a top plate of the right support frame 59, and the right belt wheel III 56 is fixed at an output end of the right servo motor II 57; the right tensioning wheel 54 is installed on the top plate of the right support frame 59; and the right belt wheel III 56, the two right belt wheels IV 53 and the right tensioning wheel 54 are connected by the right synchronous belt II 55.

The upper synchronous clamping driving system comprises shafts II 32, a left servo motor III 33, bearing blocks II 34, a left belt wheel V 35, a left sliding table 36, a left synchronous belt III 37, left belt wheels VI 38, guide rails III 39, a lifting plate 40, gear racks II 41, a gear II 42, upper guide pillars 43, upper guide sleeves 44, lifting hydraulic cylinders 45, right belt wheels VI 46, a right synchronous belt III 47, a right sliding table 48, a right belt wheel V 49, bearing blocks III 50, a right servo motor III 51 and shafts III 52. The upper sides of the left sliding table 36 and the right sliding table 48 are installed under the lifting plate 40 via the guide rails III 39; one gear rack II 41 is fixed on each of the left sliding table 36 and the right sliding table 48, and the gear II 42 engaged with the gear racks II 41 is installed below the lifting plate 40; the two bearing blocks II 34 are fixed under the left sliding table 36, the two shafts II 32 of which top ends are provided with the left belt wheels VI 38 respectively are installed in the bearing blocks II 34 via bearings; the left servo motor III 33 is fixed under the left sliding table 36, the left belt wheel V 35 is installed at an output end of the left servo motor III 33, and the left belt wheel V 35 and the left belt wheels VI 38 are connected by the left synchronous belt III 37; the two bearing blocks III 50 are fixed under the right sliding table 48, the two shafts III 52 of which top ends are provided with the right belt wheels VI 46 respectively are installed in the bearing blocks III 50 via bearings; the right servo motor III 51 is fixed under the right sliding table 48, and the right belt wheel V 49 is installed at an output end of the right servo motor III 51; the right belt wheel V 49 and the right belt wheels VI 46 are connected by the right synchronous belt III 47; the two lifting hydraulic cylinders 45 and the four upper guide sleeves 44 are fixed on a top end of the rack 1; and the four upper guide pillars 43 matched with the four upper guide sleeves 44 are fixed on the lifting plate 40, and output ends of the lifting hydraulic cylinders 45 are hinged to the upper side of the lifting plate 40.

During a working process, the lower synchronous clamping driving system enables a vehicle wheel to rotate under the clamped state, after a proper position is found, the left support system moves towards the right, the right support system moves towards the left and thus the left support rolls 26 and the right support rolls 58 contact the rotating vehicle wheel; meanwhile, the upper synchronous clamping driving system also enables the two shafts II 32 and two shafts III 52 to clamp the vehicle wheel and apply auxiliary clamping forces to drive the vehicle wheel to rotate; and after the left impressing system and the right impressing system rise to different heights respectively, impression carving can be performed on different positions of a back cavity of the vehicle wheel.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An improved vehicle wheel rolling carving device, which comprises a left impressing system, a right impressing system, a lower synchronous clamping driving system, a left support system, a right support system, an upper synchronous clamping driving system, a rack and a clamping cylinder II; characterized in that:

the left impressing system comprises a left jacking hydraulic cylinder, left guide pillars I, a bottom plate, a guide rail I, left guide sleeves I, a left sliding plate I, a left tensioning hydraulic cylinder, a left lifting frame, a left servo motor I, a left press roll, a left belt wheel I, a left synchronous belt I and a left belt wheel II;

the left sliding plate I on which the four left guide sleeves I are fixed is installed above the bottom plate via the guide rail I; the four left guide pillars I matched with the left guide sleeves I are fixed under the left lifting frame, the left jacking hydraulic cylinder is fixed under the left sliding plate I, and an output end of the left jacking hydraulic cylinder is connected with the lower side of the left lifting frame; the left tensioning hydraulic cylinder is fixed on the left side of the rack, and an output end of the left tensioning hydraulic cylinder is connected with the left sliding plate I; the left press roll of which an upper end is provided with the left belt wheel II is installed on the left side of the left lifting frame via a bearing; and the left servo motor I is fixed on the right side of the left lifting frame, the left belt wheel I is fixed at an output end of the left servo motor I, and the left belt wheel I and the left belt wheel II are connected by the left synchronous belt I;

the right impressing system comprises a right belt wheel II, a right synchronous belt I, a right belt wheel I, a right press roll, a right servo motor I, a right lifting frame, a right tensioning hydraulic cylinder, a right sliding plate I, right guide sleeves I, right guide pillars I and a right jacking hydraulic cylinder; the right sliding plate I on which the four right guide sleeves I are fixed is installed above the bottom plate via the guide rail I; the four right guide pillars I matched with the right guide sleeves I are fixed under the right lifting frame, the right jacking hydraulic cylinder is fixed under the right sliding plate I, and an output end of the right jacking hydraulic cylinder is connected with the lower side of the right lifting frame; the right tensioning hydraulic cylinder is fixed on the right side of the rack, and an output end of the right tensioning hydraulic cylinder is connected with the right sliding plate I; the right press roll of which an upper end is provided with the right belt wheel II is installed on the right side of the right lifting frame via a bearing; and the right servo motor I is fixed on the left side of the right lifting frame, the right belt wheel I is fixed at an output end of the right servo motor I, and the right belt wheel I and the right belt wheel II are connected by the right synchronous belt I;

the lower synchronous clamping driving system comprises a middle plate, guide rails II, gear racks I, a left sliding plate II, shafts I, bearing blocks I, rolling wheels, a right sliding plate II, a clamping cylinder I, a drive motor and gears I; the left sliding plate II and the right sliding plate II are installed above the middle plate via the guide rails II; two bearing blocks I are fixed on each of the left sliding plate II and the right sliding plate II, and the two gear racks I are fixed under each of the left sliding plate II and the right sliding plate II; the two gears I engaged with the gear racks I are also fixed above the middle plate; the four shafts I on which the rolling wheels are fixed respectively are installed in the four bearing blocks I via bearings; the drive motor is fixed under the right sliding plate II, and an output end of the drive motor is connected with one of the shafts I; and the clamping cylinder I is fixed on the right side of the rack, and an output end of the clamping cylinder I is connected with the right sliding plate II;

the left support system comprises left guide pillars II, left guide sleeves II, a left support hydraulic cylinder, a left support frame, left support rolls, a left servo motor II, a left belt wheel III, a left synchronous belt II, a left tensioning wheel and left belt wheels IV; the four left guide sleeves II are fixed on the left side of the rack, the four left guide pillars II matched with the four left guide sleeves II are fixed on the left side of the left support frame; the left support hydraulic cylinder is fixed on the left side of the rack, and an output end of the left support hydraulic cylinder is connected with the left support frame; the two left support rolls of which upper ends are provided with the left belt wheels IV respectively are installed on the left support frame via bearings; the left servo motor II is fixed under a top plate of the left support frame, and the left belt wheel III is fixed at an output end of the left servo motor II; the left tensioning wheel is installed on the top plate of the left support frame; and the left belt wheel III, the two left belt wheels IV and the left tensioning wheel are connected by the left synchronous belt II;

the right support system comprises right belt wheels IV, a right tensioning wheel, a right synchronous belt II, a right belt wheel III, a right servo motor II, right support rolls, a right support frame, a right support hydraulic cylinder, right guide sleeves II and right guide pillars II; the four right guide sleeves II are fixed on the right side of the rack, the four right guide pillars II matched with the four right guide sleeves II are fixed on the right side of the right support frame; the right support hydraulic cylinder is fixed on the right side of the rack, and an output end of the right support hydraulic cylinder is connected with the right support frame; the two right support rolls of which upper ends are provided with the right belt wheels IV respectively are installed on the right support frame via bearings; the right servo motor II is fixed under a top plate of the right support frame, and the right belt wheel III is fixed at an output end of the right servo motor II; the right tensioning wheel is installed on the top plate of the right support frame; and the right belt wheel III, the two right belt wheels IV and the right tensioning wheel are connected by the right synchronous belt II; and the upper synchronous clamping driving system comprises shafts II, a left servo motor III, bearing blocks II, a left belt wheel V, a left sliding table, a left synchronous belt III, left belt wheels VI, guide rails III, a lifting plate, gear racks II, a gear II, upper guide pillars, upper guide sleeves, lifting hydraulic cylinders, right belt wheels VI, a right synchronous belt III, a right sliding table, a right belt wheel V, bearing blocks III, a right servo motor III and shafts III; the upper sides of the left sliding table and the right sliding table are installed under the lifting plate via the guide rails III; one gear rack II is fixed on each of the left sliding table and the right sliding table, and the gear II engaged with the gear racks II is installed below the lifting plate; the two bearing blocks II are fixed under the left sliding table, the two shafts II of which top ends are provided with the left belt wheels VI respectively are installed in the bearing blocks II via bearings; the left servo motor III is fixed under the left sliding table, the left belt wheel V is installed at an output end of the left servo motor III, and the left belt wheel V and the left belt wheels VI are connected by the left synchronous belt III; the two bearing blocks III are fixed under the right sliding table, the two shafts III of which top ends are provided with the right belt wheels VI respectively are installed in the bearing blocks Ill via bearings; the right servo motor III is fixed under the right sliding table, and the right belt wheel V is installed at an output end of the right servo motor III; the right belt wheel V and the right belt wheels VI are connected by the right synchronous belt III; the two lifting hydraulic cylinders and the four upper guide sleeves are fixed on a top end of the rack; and the four upper guide pillars matched with the four upper guide sleeves are fixed on the lifting plate, and output ends of the lifting hydraulic cylinders are hinged to the upper side of the lifting plate.

* * * * *